US008269672B2

(12) United States Patent
Tinaphong et al.

(10) Patent No.: US 8,269,672 B2
(45) Date of Patent: Sep. 18, 2012

(54) OMNI-DIRECTIONAL, MULTI-POLARITY, LOW PROFILE PLANAR ANTENNA

(75) Inventors: Prapan Paul Tinaphong, Westfield, IN (US); Hong Yin, Carmel, IN (US)

(73) Assignee: Audiovox Corporation, Hauppauge, NY (US)

( * ) Notice: Subject to any disclaimer, the term of this patent is extended or adjusted under 35 U.S.C. 154(b) by 267 days.

(21) Appl. No.: 12/454,888

(22) Filed: May 26, 2009

(65) Prior Publication Data

US 2009/0289853 A1 Nov. 26, 2009

Related U.S. Application Data

(60) Provisional application No. 61/128,801, filed on May 23, 2008.

(51) Int. Cl.
*H01Q 1/38* (2006.01)

(52) U.S. Cl. ..... 343/700 MS; 343/846; 343/893

(58) Field of Classification Search ..... 343/700 MS, 343/702, 846, 893
See application file for complete search history.

(56) References Cited

U.S. PATENT DOCUMENTS

| | | | | |
|---|---|---|---|---|
| 6,429,828 | B1 | 8/2002 | Tinaphong et al. | 343/824 |
| 2003/0080921 | A1 | 5/2003 | Wen et al. | 343/909 |
| 2007/0229379 | A1 | 10/2007 | Eckwielen et al. | 343/757 |
| 2007/0262912 | A1 | 11/2007 | Eckwielen et al. | 343/818 |

OTHER PUBLICATIONS

Notification of Transmittal of the International Search Report and the Written Opinion of the International Searching Authority, or the Declaration; International Search Report; and the Written Opinion of the International Searching Authority.

*Primary Examiner* — Dieu H Duong
(74) *Attorney, Agent, or Firm* — Gerald T. Bodner

(57) ABSTRACT

An omni-directional, multi-polarity, low profile planar antenna for receiving high definition television signals includes a dielectric substrate having a first side and a second side on which are respectively formed first and second conductive patterns. Each conductive pattern includes segments functioning as antenna elements which are arranged to form a first modified H-shaped pattern on the first side of the dielectric substrate, and a second modified H-shaped pattern on the second side of the dielectric substrate which is disposed substantially ninety degrees with respect to the first modified H-shaped pattern. Each of the H-shaped patterns includes an extended S-shaped segment.

8 Claims, 9 Drawing Sheets

OMNI-DIRECTIONAL, MULTI-POLARITY, LOW PROFILE PLANAR ANTENNA

CROSS-REFERENCE TO RELATED APPLICATION

This application is related to U.S. Provisional Application Ser. No. 61/128,801, filed on May 23, 2008, and entitled "Omni-Directional, Multi-Polarity, Low Profile Planar Antenna", the disclosure of which is incorporated herein by reference. This application claims the benefit of priority under 35 U.S.C. 119 and/or 35 U.S.C. 120 to the aforementioned related provisional application.

BACKGROUND OF THE INVENTION

1. Field of the Invention

The present invention generally relates to antennas for receiving broadcast signals such as television signals, and more specifically relates to television antennas for receiving digitally formatted broadcast signals.

2. Description of the Prior Art

Conventional indoor TV antenna systems generally include two separate antennas for respective VHF and UHF reception. The antenna for receiving the VHF bands employs a pair of telescopic elements forming a dipole with each of the elements having a maximum length of from 4 to 6 feet (1.5 to 2.5 m). The two elements usually are mounted to permit the elements to be spread apart to increase or shorten the dipole length and those elements are commonly referred to as "rabbit ears." The indoor UHF antenna typically is a loop having a diameter of about 7½ inches (20 centimeters).

One problem associated with the conventional indoor antenna systems is that the physical dimension of the VHF dipole is undesirably long for the ordinary setting in a living room and that the length as well as the direction of the dipole elements may need to be adjusted depending upon the receiving channels. The second problem is that the performance of such conventional indoor VHF/UHF antennas changes in response to changes of the physical conditions around the antenna elements. For example, it is difficult for a user to make proper adjustment of the antennas since a human body coming into contact with an antenna changes the electromagnetic conditions associated with the antenna elements. The third problem is that the conventional indoor antenna systems do not always provide a sufficient signal level for good reception.

U.S. Pat. No. 6,429,828, which issued on Aug. 6, 2002 to Prapan Paul Tinaphong, et al., the disclosure of which is incorporated herein by reference, describes an antenna system for receiving VHF/UHF broadcast signals which comprises a planar antenna and a tuner unit which includes a tuning arrangement. A gain controllable amplifier may be included in the tuner unit where necessary. The planar antenna includes a pair of antenna elements which are substantially identical in shape. These elements are located on the respective surfaces of a dielectric board. The tuning arrangement includes a plurality of matching networks for the respective plurality of bands of broadcast frequencies.

The antenna and antenna system described in the aforementioned Tinaphong, et al. patent work well for receiving analog television broadcast signals. Now, the inventors herein have improved the planar antenna described in the aforementioned Tinaphong, et al. patent to have even better reception characteristics, including the capability to receive digitally formatted broadcast television signals.

NTSC (National Television Standards Committee) broadcast signals were adopted by the United States in 1941 as the standardized television broadcasting and video format which is currently in use. The NTSC signals are analog signals. However, the NTSC analog format will be phased out on Jun. 12, 2009, and all TV broadcasting signals will be changed to an ATSC (Advanced Television Systems Committee) digital format. The ATSC standard for digital television has been adopted by the United States and several other countries.

As a result, the television receiver antenna will become a critical element for the new digital TV reception system in order to receive all new digital TV channels which will be mainly in the UHF (ultra high frequency) band, with some channels being in the upper VHF (very high frequency) band covering conventional TV channels 7 to 13. Without a good omni-directional TV antenna, consumers will not be able to receive all of the digital ATSC signals when the broadcast format change comes about. All conventional indoor or outdoor antennas will only receive the signals when the antenna is pointed in the direction of the TV broadcasting station; otherwise, the converter box or ATSC television will only show a blank screen on the television. With the analog NTSC broadcast signals, consumers still can see some pictures or snowy images when the antenna is not pointed into the right direction, and consumers can still rotate the antenna to the right direction by watching the picture quality change the display on the television. Digital televisions that receive ATSC signals will either display a picture or a blank or dark screen, and thus provide no indication that will alert consumers that they should rotate the antenna to achieve better channel reception in the same area.

OBJECTS AND SUMMARY OF THE INVENTION

It is an object of the present invention to provide a low profile planar antenna for the reception of digitally formatted television broadcast signals.

It is another object of the present invention to provide an indoor television antenna which is omni-directional and, therefore, needs no adjustment for receiving a broad range of television broadcast signals.

It is yet another object of the present invention to provide a television antenna which receives both horizontally polarized and vertically polarized television broadcast signals.

It is a further object of the present invention to provide a low profile planar antenna for use with television receivers which receives both analog and digital television signals.

It is still a further object of the present invention to provide a television antenna which resolves issues with multi-path and other forms of interference from adjacent channels, as well as maintain an excellent SWR (standing wave ratio) with proper impedance matching between the ATSC tuner on the television side and the output impedance of the antenna.

It is still another object of the present invention to provide a television antenna which optimizes ATSC television broadcast signal reception, as well as resolve the channel drop off problem when the antenna is not pointed to the right direction with the right polarization.

It is another object of the present invention to provide a reception antenna for television receivers whose physical dimensions are calculated to optimize the size of the antenna for perfect or near perfect ATSC signal reception.

In accordance with one form of the present invention, an omni-directional, multi-polarity, low profile planar antenna includes a plurality of microstrip elements formed on one side of a substrate, such as a phenolic printed circuit board or a Plexiglas substrate, or the like, the substrate having dielectric properties. Also, microstrip antenna elements are formed on the opposite side of the substrate. The arrangement of the antenna elements on one side of the substrate is substantially the same as the arrangement of the elements situated on the other side of the substrate; however, the arrangement of the elements on the second side is oriented or offset ninety degrees from the arrangement of the elements on the first side of the substrate. Each arrangement defines a modified H-shaped pattern of conductive antenna elements, and each modified H-shaped pattern of conductive elements includes an extended S-shaped main region.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
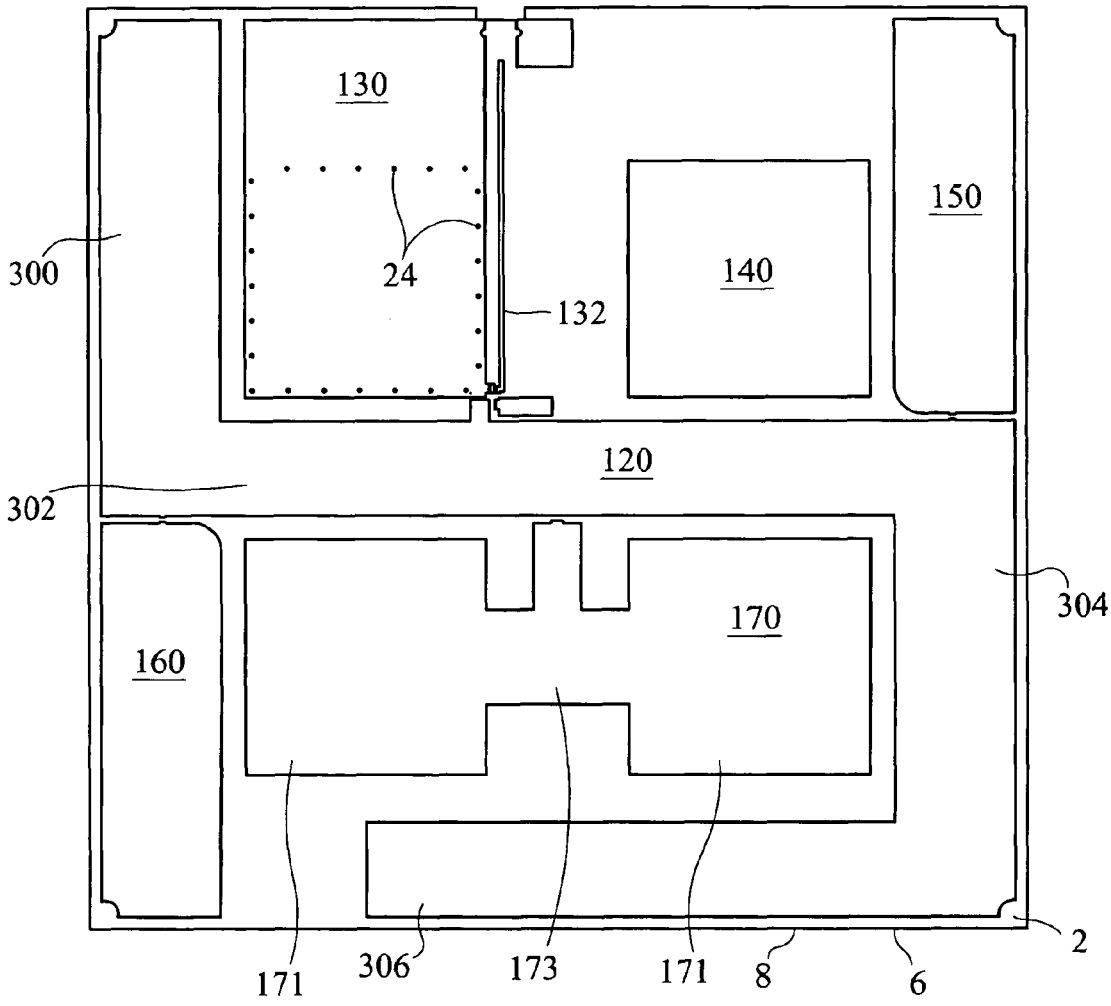
FIG. 1 is a top plan view of a first form of the planar antenna of the present invention, the planar antenna being illustrated without discrete components.

Referring initially to FIGS. 1-4 of the drawings, it will be seen that an omni-directional, multi-polarity, low profile planar antenna constructed in accordance with a first form of the present invention includes elements which are developed based on microstrip techniques and which are situated on a first side 2 and an opposite second side 4 of a planar substrate 6 having dielectric properties. More specifically, the antenna elements on both sides of the substrate 6 are dimensioned and arranged in unique patterns which make it possible for the planar antenna to provide omni-directional reception of horizontally polarized and vertically polarized television signals, the omni-directionality properties of the antenna being seen from the radiation pattern plot of the antenna shown in FIG. 5. Thus, no adjustment for the direction of the antenna is necessary once it is installed by the user. The omni-directionality of the planar antenna of the present invention is believed to result from the fact that the majority of RF (radio frequency) currents flow along the edges of every one of the planar antenna elements. Furthermore, because the antenna is responsive to multi-polarity signals, it may be mounted vertically or horizontally by the user on a supporting structure.

As shown in FIGS. 1-4, the antenna elements are preferably etched directly on a printed circuit board (PCB) 8, such as a printed circuit board commonly referred to in the industry as "FR-4" (0.062" thickness, double-side PCB board with a dielectric constant of between about 4.3 and about 4.5). The dimension of the PCB 8 is approximately 9.75×9.75 inches. Both VHF and UHF antenna elements are formed on each side 2, 4 of the PCB 8, and VHF and UHF elements on one side 2 are substantially identical, in shape, to respective VHF and UHF elements on the other side 4 of the PCB 8. In addition, the former are rotated 90 degrees with respect to the latter.

For VHF signal reception, the planar antenna of the present invention includes the following three separate regions (reference numbers for the respective corresponding regions on the bottom side are shown in the parentheses): 1) extended "S"-shaped main region 120 (220); 2) a first supplemental region 150 (250); and 3) a second supplemental region 160 (260).

Each of the extended "S"-shaped main regions 120 (220) on the first side 2 of the printed circuit board 8 (or dielectric substrate 6) and on the second side 4, respectively, includes 4 interconnected legs or sub-segments, that is, a first leg 300 (400), a second leg 302 (402), a third leg 304 (404) and a fourth leg 306 (406). The first leg 300 (400) is connected to and disposed at a right angle to the second leg 302 (402), the second leg is connected to and disposed at a right angle to the third leg 304 (404), and the fourth leg 306 (406) is connected to and disposed at a right angle to the third leg 304 (404). The first leg 300 (400) and the third leg 304 (404) extend from opposite axial ends of the second leg 302 (402) in opposite directions, and the fourth leg 306 (406) extends from the third leg 304 (404) in a direction which is parallel to the second leg 302 (402) and in a direction towards the axial end of the second leg at which the first leg 300 (400) is connected.

The first leg 300 of the main region 120 on the first side 2 of the dielectric substrate 6 has a width of preferably about 1.25 inches, an outside length (relative to the PCB 8) of preferably about 5.25 inches, and an inside length of preferably about 4.25 inches. The inside length side of the first leg 300 of the main region 120 is spaced from a ground plane region 130, which will be described in greater detail, by a gap of preferably about 6.5 millimeters. The second leg 302 of the main region 120 has an overall length of preferably about 9.5 inches (which includes the widths of the first and third legs 300, 304), and the width of the second leg 302 is preferably about 1 inch. The overall length of the third leg 304 of the main region 120 is preferably about 5.25 inches on its outside dimension and preferably about 3.25 inches on its inside dimension (that is, outside and inside with respect to the edge of the PCB 8). The width of the third leg 304 of the main region 120 is preferably about 1.25 inches. The extended fourth leg 306 of the main region 120 has an overall length of preferably about 6.75 inches (which includes the width of the third leg 304) with an inside length dimension of preferably about 5.5 inches. The width of the fourth leg 306 of the main region 120 is preferably about 1 inch. The spacing between the second leg 302 of the main region 120 and a UHF region 170, which will be described in greater detail, is a gap of preferably about 6.5 millimeters. The spacing between the third leg 304 of the main region 120 and the UHF region 170 is a gap of preferably about 6.5 millimeters. The spacing between the fourth leg 306 of the main region 120 and the UHF region 170 is preferably about 1.25 centimeters. Preferably, the maximum width of the fourth leg 306 is the same as, or less than, the width of the third leg 304 to provide a broader signal reception bandwidth.

The first leg (400) of the main region (220) situated on the second side 4 of the PCB 8 (or dielectric substrate 6) has a width of preferably about 1.25 inches, an outside length of preferably about 5.25 inches, and an inside length of preferably about 4.25 inches. The inside length side of the first leg (400) of the main region (220) is spaced from a UHF region (270), which will be described in greater detail, by a gap of preferably about 6.5 millimeters. The second leg (402) of the main region (220) has an overall length of preferably about 9.5 inches (which includes the widths of the first and third legs (400, 404)), and the width of the second leg (402) is preferably about 1 inch. The overall length of the third leg (404) of the main region (220) is preferably about 5.25 inches on its outside dimension and preferably about 3.25 inches on its inside dimension (that is, outside and inside with respect to the edge of the PCB 8). The width of the third leg (404) of the main region (220) is preferably about 1.25 inches. The extended fourth leg (406) of the main region (220) has an overall length of preferably about 3.5 inches (which includes the width of the third leg (404)) with an inside length dimension of preferably about 2.25 inches. The width of the fourth leg (406) of the main region (220) is preferably about 1 inch. The spacing between the second leg (402) of the main region (220) and the UHF region (270) is a gap of preferably about 6.5 millimeters and the spacing between the second leg (402) of the main region (220) and a ground plane region (230), which will be described in greater detail, is preferably about 6.5 millimeters. The spacing between the third leg (404) of the main region (220) and the ground plane region (230) is a gap of preferably about 6.5 millimeters. The spacing between the fourth leg (406) of the main region (220) and the ground plane region (230) is preferably between about 2 millimeters and about 2.5 millimeters.

First supplemental region 150 (250) is preferably approximately 1.25 inches in width by preferably about 4.1735 inches in length and separated from main region 120 (220) by a gap of preferably approximately 2 millimeters. First supplemental region 150 (250) is electrically coupled to main region 120 (220) through inductors L3 (L5), for example, a 240 nanohenry (nH) high Q surface-mounted chip inductor L3 on the first side 2 of the printed circuit board 8 (see FIG. 3), and a 220 nanohenry (nH) similar inductor (L5) on the second side 4 of the printed circuit board 8 (see FIG. 4). It has been found that this arrangement extends the effective electrical length of first supplemental region 150 (250).

Second supplemental region 160 (260) is substantially identical to first supplemental region 150 (250) in dimensions (i.e., preferably about 1.25 inches in width by preferably about 4.1735 inches in length and separated from main region 120 (220) by a gap of preferably approximately 2 millimeters). Second supplemental region 160 on the first side of the printed circuit board is coupled to main region 120 through capacitor C2, for example, a 3.9 picofarad (pF) surface-mounted chip capacitor. Second supplemental region (260) on the second side 4 of the printed circuit board 8 is coupled to main region (220) through an inductor (L4), which is also preferably a 240 nanohenry (nH) high Q surface-mounted chip inductor. It has been found that second supplemental region 160 (260) coupled via capacitor C2 and inductor (L4) significantly improves the overall voltage standing wave ratio (VSWR) characteristics of the planar antenna for the lower VHF television band of frequencies (50-88 MHz).

There is a reflector region 140 preferably only on the top side of the PCB. Reflector region 140 functions as a reflector for first supplemental region 150. It has been found that reflector region 140 improves the overall performance of the planar antenna in the upper VHF television band of frequencies (174-216 MHz). The reflector region 140 preferably has dimensions of about 2.5 inches in width by about 2.5 inches in length and is spaced from the first supplemental region 150 by a gap of preferably about 6.5 millimeters, and is spaced from the main region 120 by a gap of preferably about 6.5 millimeters.

UHF antenna elements 170 (270) feature an "H"-shaped configuration and are formed on the respective sides 2, 4 of the printed circuit board 8 (or dielectric substrate 6). As described above, these two UHF elements are also substantially identical in shape, and one is oriented 90 degrees from the other.

Each opposite end 171 (271) of the H-shaped UHF element 170 (270) is preferably square in shape and is preferably approximately 2.5 inches in width by approximately 2.5 inches in length. The two ends are connected together with preferably an approximately 1 inch in width by approximately 1.5 inches in length microstrip transmission line 173 (273) to form the "H"-shaped configuration. UHF element 170 (270) is coupled to the approximately middle point of the microstrip transmission line leg 302 (402) of the extended S-shaped VHF element 120 (220) through inductor L1 (L2), preferably a 33 nanohenry (nH) high Q surface-mounted chip inductor (see FIGS. 3 and 4).

The top side 2 of the PCB 8 (or dielectric substrate 6) also includes a ground plane region 130. Ground plane region 130 is preferably rectangular in shape and is preferably approximately 4 inches in length and approximately 2.5 inches in width. The bottom side 4 of the PCB 8 (or dielectric substrate 6) also includes a ground plane region (230). The dimension of ground plane region (230) is preferably approximately 6.5 inches in length including a first section (231) having a length of preferably about 3.74 inches and a second section (233) having a length of preferably about 2.76 inches. The width of the ground plane region (230) is preferably about 3.25 inches extending over the first section (231) of the ground plane region (230) and preferably about 2.5 inches extending over the second section (233) of the ground plane region (230). The ground plane region 130 on the top side 2 of the PCB 8 is electrically coupled to the ground plane region (230) on the bottom side 4 of the PCB 8 by a series of vias 24 formed through the thickness of the PCB 8 (or dielectric substrate 6). The ground plane region 130 is spaced on its length and width sides from the main region 120 by a gap of preferably about 6.5 millimeters. Similarly, the ground plane region (230) is spaced from the main region (220) on its length and width sides by a gap of preferably about 6.5 millimeters.

Female "F" connector 131 for receiving the mating male connector 21 of coaxial transmission line 20 is connected to the ground plane region 130 at the edge of the PCB 8. The feet 22 (ground line) of connector 131 are connected to both ground plane region 130 and, through the interconnecting vias 24, the ground plane region (230) on the second side 4 of the PCB 8. The signal line center conductor 26 of connector 131 is connected to signal transmission line 132 formed on the top side 2 of the PCB 8. It has been found that both of the ground plane regions 130 (230) contribute to the stabilization of the overall performance of the planar antenna system notwithstanding the changes of the physical conditions around the planar antenna.

Figure 3:
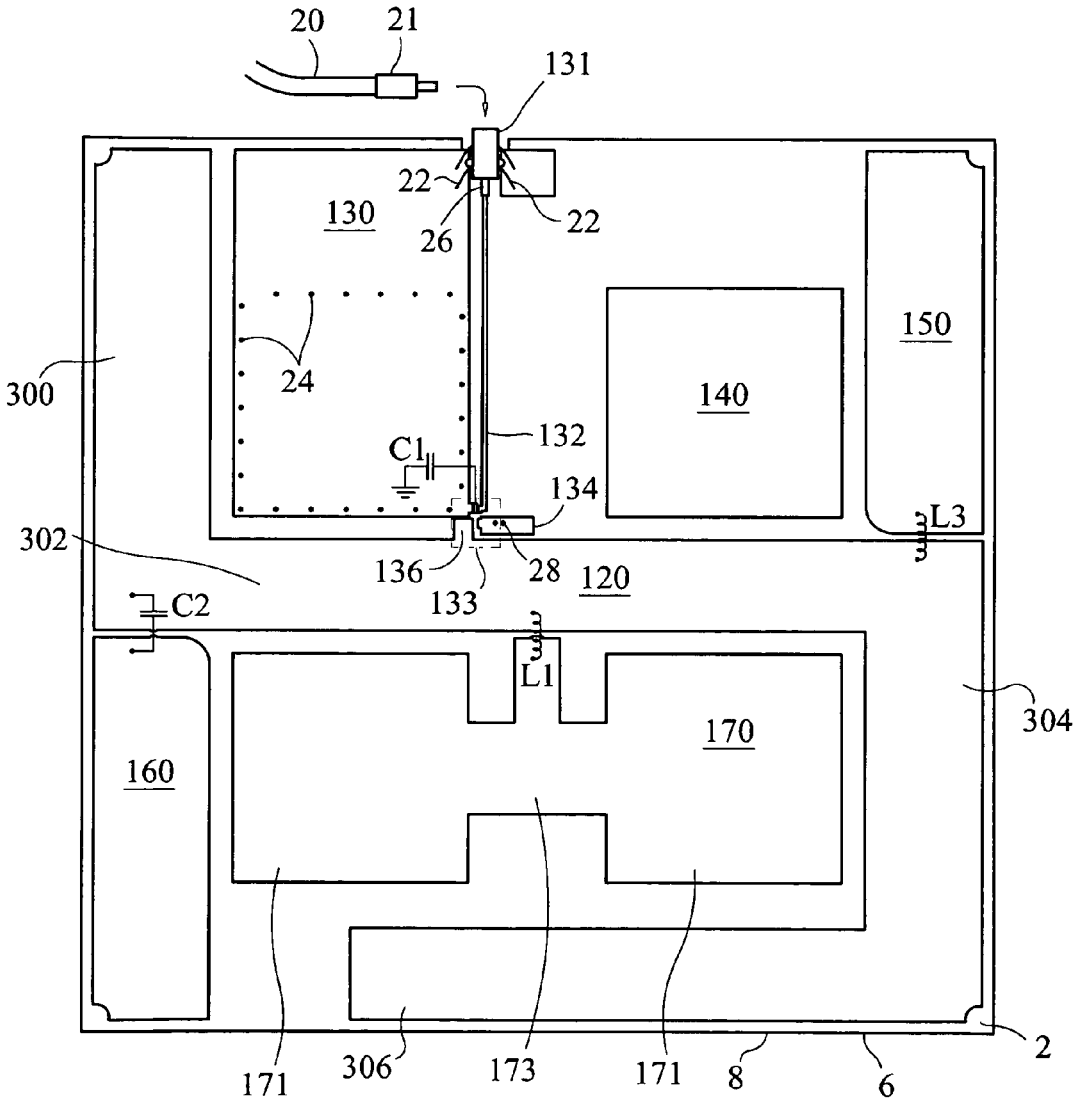
FIG. 3 is a top plan view of the first form of the planar antenna of the present invention, illustrating the values and arrangement of discrete components (e.g., capacitors and inductors) situated thereon.

As shown in FIG. 3, a 4:1 balun transformer 133 (shown much larger in FIG. 3 than in actuality) is located on the top side 2 of the PCB 8 (or dielectric substrate 6) for impedance matching between the planar antenna elements and coaxial cable 20. Ends of the first winding of transformer 133 are respectively coupled to connecting point 136 and connecting region 134. Connecting point 136 is formed as a tab extending from one lateral side, and located approximately at or near the middle, of the transmission line leg 302 of extended S-shaped VHF element 120. Connecting region 134 is connected to connecting point (234) of VHF element (220) on the bottom side 4 via two or more through-holes (vias) 28. Ends of the second winding of transformer 133 are coupled to respective transmission line 132 and ground plane 130. Matching capacitor C1 (preferably 0.5 pF) is coupled between the center tap of the second winding and ground plane 130 for better impedance matching. Micro strip transmission line 132 extends along the top surface 2 of the PCB 8 from the edge of the PCB 8 where the female connector 131 is mounted to balun transformer 133, the transmission line 132 extending parallel to an edge of ground plane region 130 and spaced apart therefrom by a gap of preferably between about 3 millimeters and about 4 millimeters. The microstrip transmission line 132 has an impedance of preferably 75 ohms to match the impedance of the coaxial cable 20 to which the antenna is connected.

The planar antenna of the present invention combines the structural features and advantages of a Yagi antenna with those of a log periodic antenna to provide omni-directionality and a relatively broad bandwidth over the frequency spectrum allotted for ATSC reception when disposed in either horizontal or vertical planes. More specifically, and referring to FIG. 3 of the drawings, it will be seen that on one side 2 of the dielectric substrate 6 of the planar antenna, second leg or segment 302 of extended S-shaped main region 120 functions as a transmission line, which is coupled to third leg or segment 304, which functions as a driven element. Fourth leg or segment 306, disposed at a right angle to driven element 304, functions as a parasitic element.

The transmission line segment (second leg 302) of extended S-shaped main region 120 is also coupled, at a right angle, to first leg or segment 300, which functions as a driven element. Second supplemental region or segment 160, which is coupled to the transmission line segment (second leg 302) of extended S-shaped main region 120 by capacitor C2, functions as another parasitic element.

First supplemental region or segment 150, coupled to the transmission line segment (second leg 302) of the extended S-shaped main region 120 through inductor L3, which effectively extends the length of segment 150, functions as a driven element. Segment 140 functions as a reflector, and segment 130 is a ground plane which is coupled to ground and to the coaxial shield of the feed transmission line 20 through one side of the matching transformer 133.

As can be seen from FIGS. 1 and 3, the extended S-shaped main region 120, with its first through fourth legs 300, 302, 304, 306, first supplemental region or segment 150 and second supplemental region or segment 160 together define a modified H-shaped pattern of conductive antenna elements on one side of the dielectric substrate or PCB, which conductive elements are provided for receiving VHF frequency components of digital ATSC television broadcast signals.

Conductive region 170 is coupled to the transmission line segment (second leg 302) of extended S-shaped main region 120 through inductor L1, and functions as a driven element for UHF reception.

Figure 2:
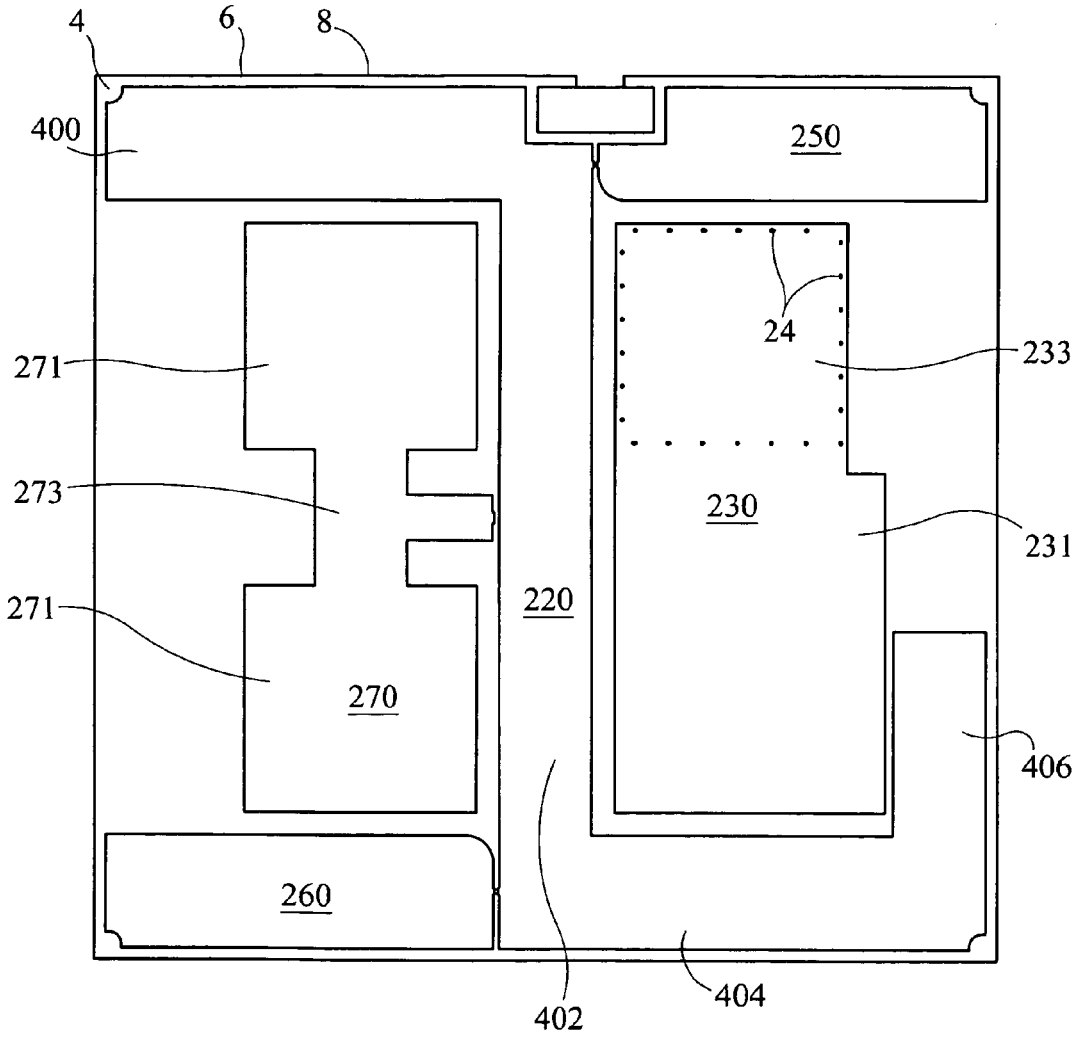
FIG. 2 is a bottom plan view of the first form of the planar antenna of the present invention, the planar antenna being illustrated without discrete components.
Figure 4:
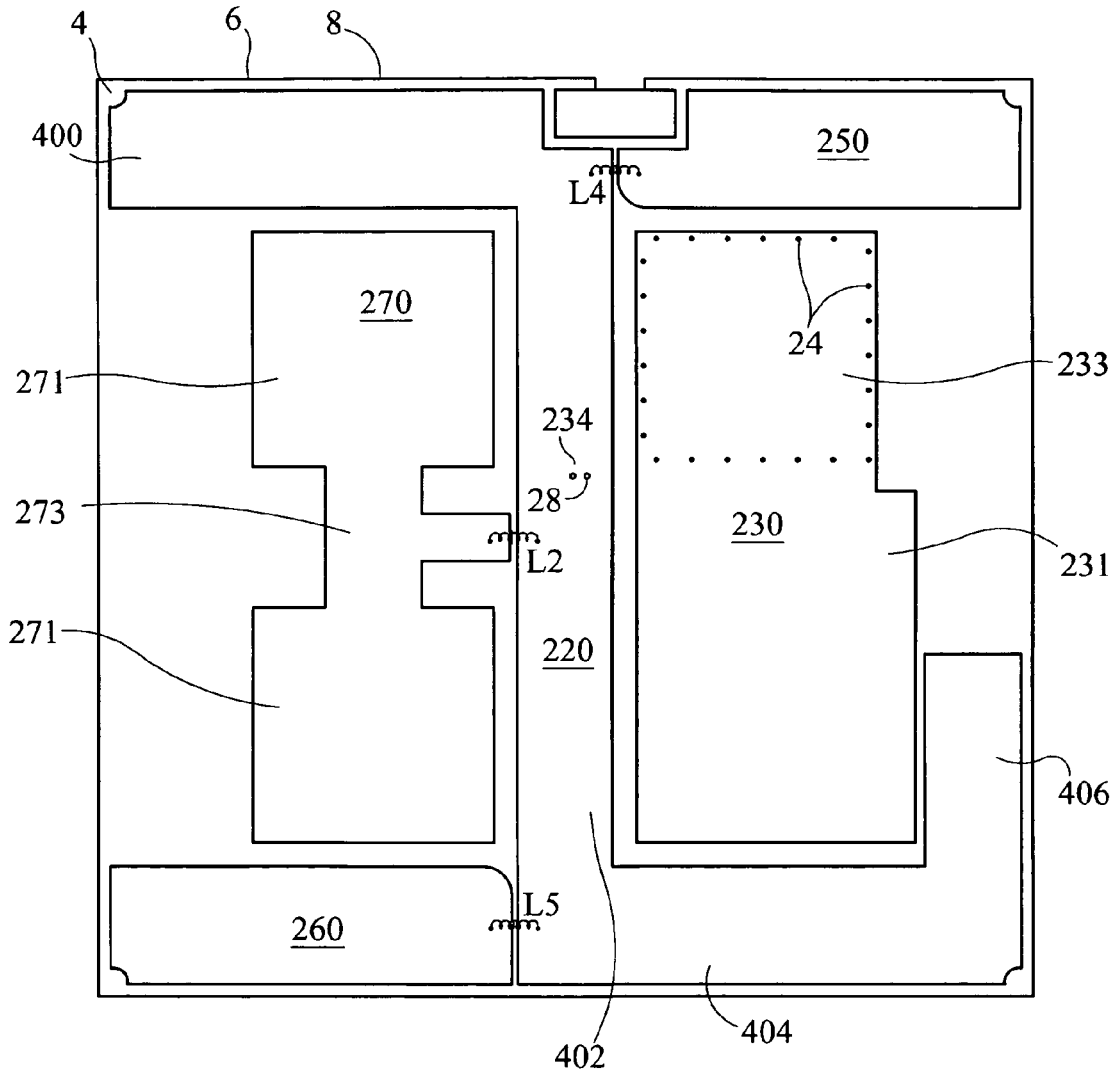
FIG. 4 is a bottom plan view of the first form of the planar antenna of the present invention, illustrating the values and arrangement of discrete components (e.g., capacitors and inductors) situated thereon.

The second side 4 of the dielectric substrate 6 of the planar antenna, as shown in FIGS. 2 and 4, has similar structural and functional elements to those described previously with respect to the first side 2 shown in FIGS. 1 and 3. More specifically, the second leg or segment (402) of the second extended S-shaped main region (220) acts as a transmission line, like the second leg or segment 302 of the first extended S-shaped main region 120 on the opposite side 2. Region or segment (270) is coupled to the transmission line second leg or segment (402) with an inductor L2, and acts as a driven element for UHF band reception. Segment (400), disposed perpendicularly to the transmission line second leg or segment (402) of the second extended S-shaped main region (220), acts as a driven element. Segment (260), disposed at a right angle and coupled to the transmission line second leg or segment (402) with an inductor L5, functions as a driven element, with inductor L5 extending the effective length of driven element segment (260). Segment (404), disposed at a right angle and coupled to the transmission line second leg or segment (402), acts as a driven element, and segment (406), disposed at a right angle to driven element segment (404), functions as a parasitic element.

Segment 250, which is disposed at a right angle and coupled to the transmission line second leg or segment (402) through an inductor L4, functions as another driven element of the planar antenna, with inductor L4 increasing the overall effective length of driven element segment (250). Segment (230) functions as a ground plane.

As can be seen from FIGS. 2 and 4, the extended S-shaped main region (220), with its first through fourth legs (400), (402), (404), (406), first supplemental region or segment (250) and second supplemental region or segment (260) together define a second modified H-shaped pattern of conductive antenna elements on the other side 4 of the dielectric substrate 6 or PCB 8, which conductive elements are provided for receiving VHF frequency components of digital ATSC television broadcast signals. As can be seen from FIGS. 1-4, the first modified H-shaped pattern of conductive elements on one side 2 of the dielectric substrate 6 is disposed substantially ninety (90) degrees with respect to the second modified H-shaped pattern of conductive elements on the other side 4 of the dielectric substrate.

Figure 5:
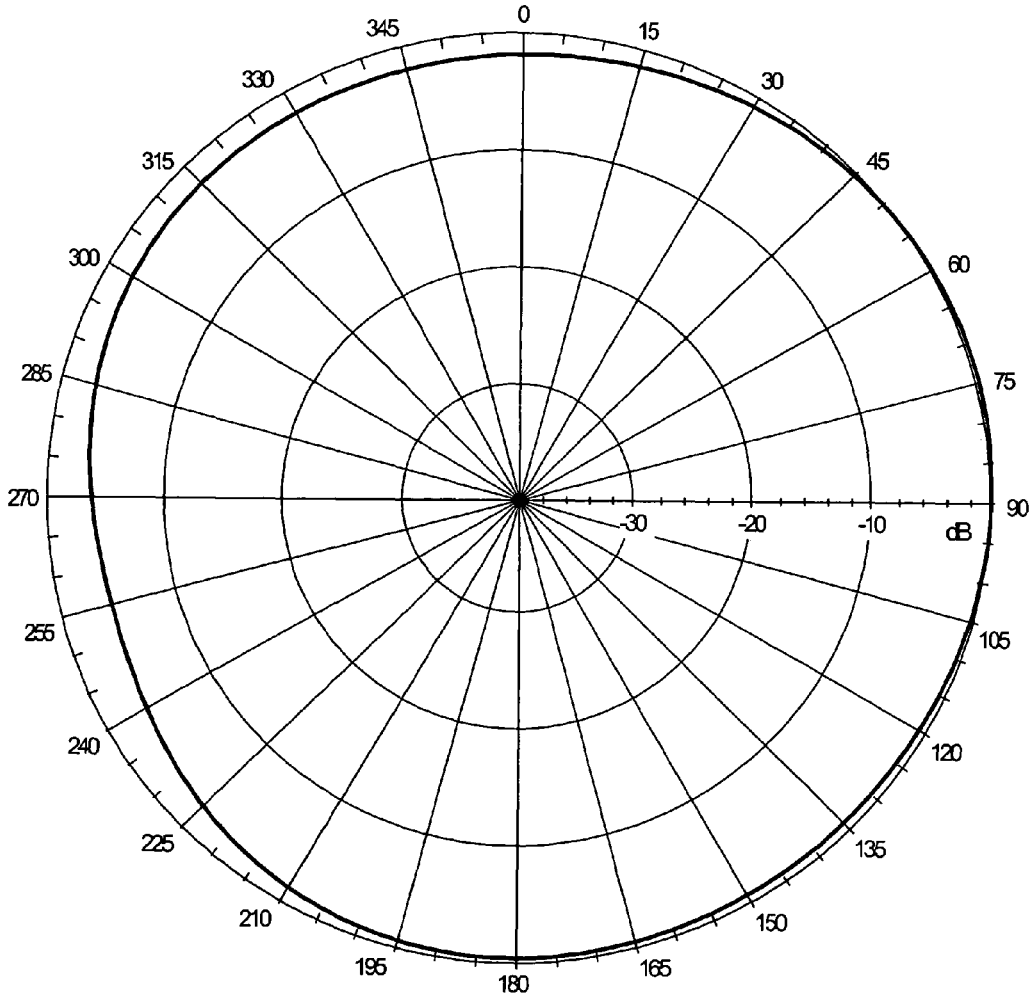
FIG. 5 is a graph which illustrates a radiation pattern of the first form of the planar antenna at a particular frequency (177 MHz).
Figure 6:
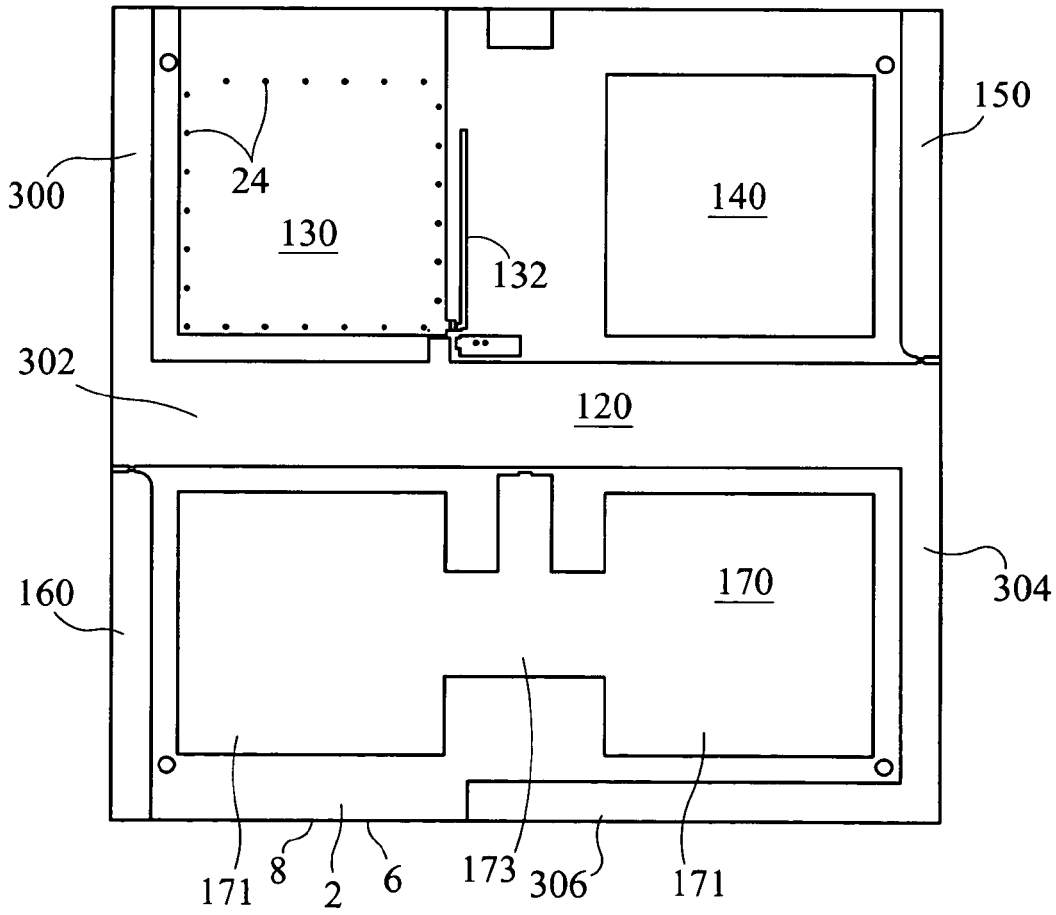
FIG. 6 is a top plan view of a second form of the planar antenna of the present invention, the planar antenna being illustrated without discrete components.

FIG. 5 is a graph of the antenna radiation pattern of the present invention at 177 MHz. As can be seen from FIG. 5, the planar antenna of the present invention is quite omni-directional.

FIGS. 6-9 relate to a second form of the planar antenna of the present invention. As can be seen from FIGS. 6-9, the second form of the planar antenna is very similar in structure to the first form of the planar antenna shown in FIGS. 1-4, and like reference numerals denote the same or similar components.

There are some differences between the first form of the planar antenna shown in FIGS. 1-4 and the second form of the planar antenna shown in FIGS. 6-9. A first difference is that the dimensions of the various segments and components of the second form may be different from the first form, as will be described in greater detail. A second difference relates to the arrangement of the segments of the second form of the planar antenna (see FIGS. 7 and 9) compared to the arrangement of the first form of the planar antenna (see FIGS. 2 and 4). A third difference is that the region (230) which functions as a ground plane in the second form of the planar antenna, now is H-shaped, whereas segment (230) on the first form of the planar antenna is substantially rectangular in shape.

Each of the first form and the second form of the planar antenna includes an extended S-shaped segment 120 (220) on each side of the dielectric substrate.

The second form of the planar antenna shown in FIGS. 6-9 is preferably etched directly on a printed circuit board (PCB) 8, formed from a CEM material with a dielectric constant of between about 5 and about 5.5. The overall dimensions of the PCB 8 are preferably about 7 and ¾ inches by about 7 and ¾ inches for the second form of the planar antenna.

The primary structural differences between the first form of the planar antenna of the present invention and the second form will now be described in greater detail. The other aspects of the two forms are substantially the same, and such common aspects have been previously described in detail in relation to the planar antenna shown in FIGS. 1-4.

Other than the dimensions of the various segments and regions, the layout of the conductive elements and other components on the first side 2 of the dielectric substrate 6 (e.g., the PCB 8) of the second form of the planar antenna (see FIGS. 6 and 8) is substantially the same as on the first side 2 of the first form of the planar antenna shown in FIGS. 1 and 3. However, it is clearly evident from comparing FIGS. 2 and 4 with FIGS. 7 and 9 of the second side 4 of the dielectric substrate 6 that the fourth leg or segment (406) of the extended S-shaped main region (220) has been moved diagonally across the dielectric substrate 6 on the second form of the planar antenna from its position on the first form, where it extended from the end of the third leg or segment (404), to now connect with and extend at a right angle from the end of the first leg or segment (400) and toward first supplemental region or segment (250) on the second form of the planar antenna, but still functioning as a parasitic element of the planar antenna.

Figure 7:
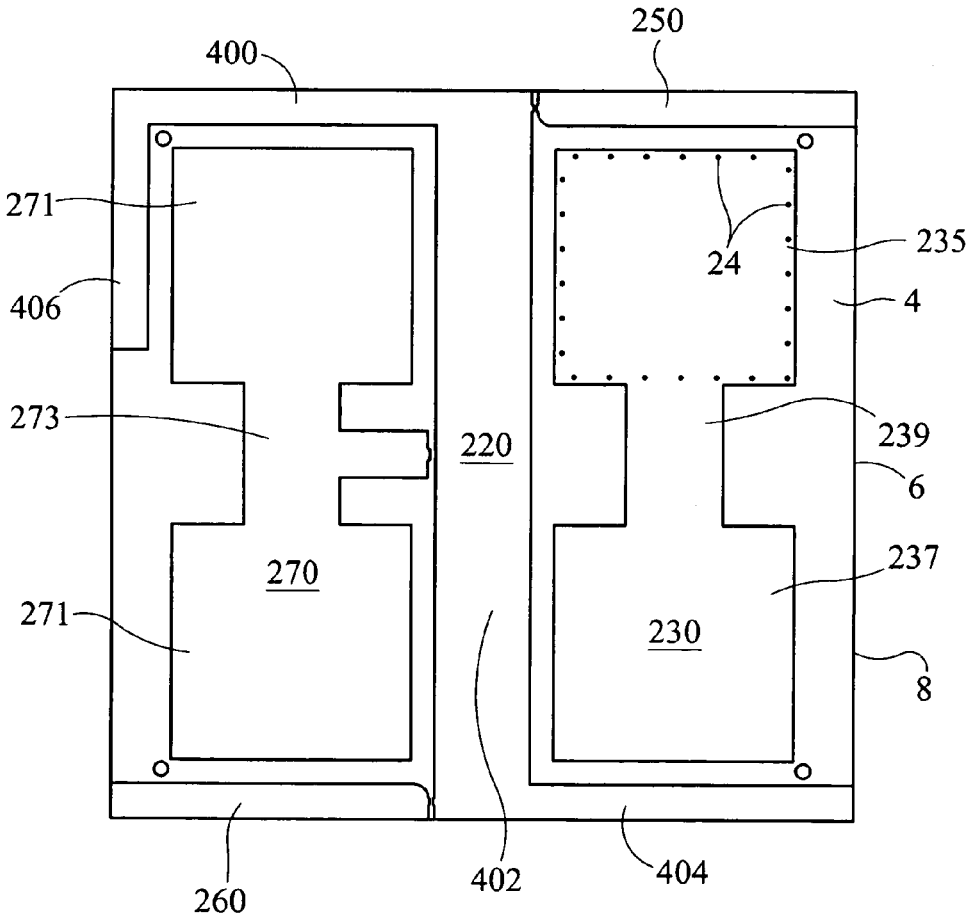
FIG. 7 is a bottom plan view of the second form of the planar antenna of the present invention, the planar antenna being illustrated without discrete components.
Figure 9:
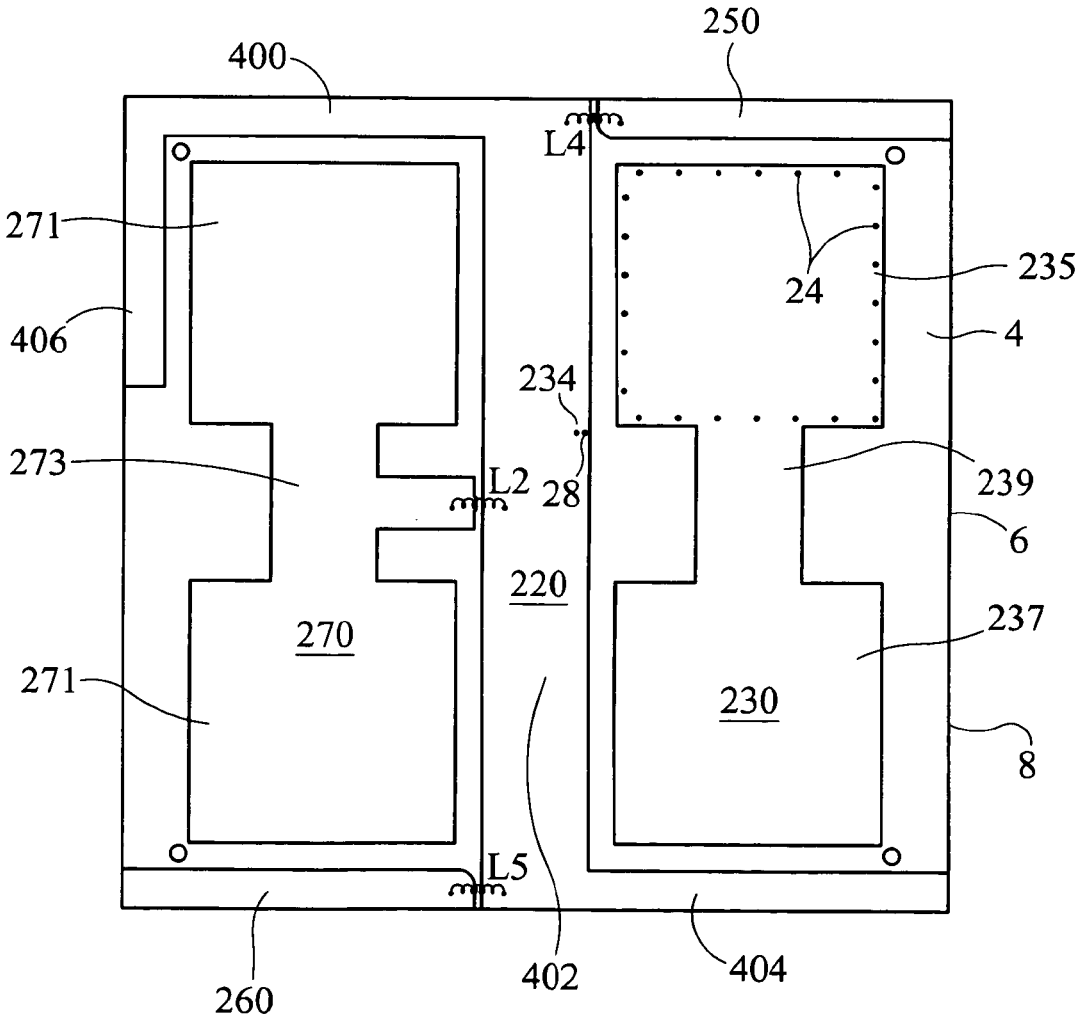
FIG. 9 is a bottom plan view of the second form of the planar antenna of the present invention, illustrating the values and arrangement of discrete components (e.g., capacitors and inductors) situated thereon.

Furthermore, the ground plane region (230) in the second form of the planar antenna includes two opposite end portions (235, 237) interconnected by a centrally disposed, narrower microstrip transmission line (239) to provide the ground plane region (230) with an H-shaped configuration, as shown in FIGS. 7 and 9.

The dimensions of the various components and regions of the second form of the planar antenna shown in FIGS. 8-11 will now be described.

The first leg 300 of the main region 120 on the first side 2 of the dielectric substrate 6 has a width of preferably about 9.5 millimeters, an outside length (relative to the edge of the PCB 8) of preferably about 11.1 centimeters, and an inside length of preferably about 8.5 centimeters. The inside length side of the first leg 300 of the main region 120 is spaced from the ground plane region 130 by a gap of preferably about 6.5 millimeters. The second leg 302 of the main region 120 has an overall length of preferably about 19.6 centimeters (which includes the widths of the first and third legs 300, 304), and the width of the second leg 302 is preferably about 2.55 centimeters. The overall length of the third leg 304 of the main region 120 is preferably about 11.1 centimeters on its outside dimension and preferably about 8.5 centimeters on its inside dimension (that is, outside and inside with respect to the edge of the PCB 8). The width of the third leg 304 of the main region 120 is preferably approximately 9.5 millimeters. The extended fourth leg 306 of the main region 120 has an overall length of preferably about 11.1 centimeters (which includes the width of the third leg 304) with an inside length dimension of preferably approximately 10.2 centimeters. The width of the fourth leg 306 of the main region 120 is preferably about 9.5 millimeters. The spacing between the second leg 302 of the main region 120 and the UHF region 170 is a gap of preferably about 6.5 millimeters. The spacing between the third leg 304 of the main region 120 and the UHF region 170 is a gap of preferably approximately 6.5 millimeters. The spacing between the fourth leg 306 of the main region 120 and the UHF region 170 is preferably approximately 9.5 millimeters. Preferably, the maximum width of the fourth leg 306 is the same as, or less than, the width of the third leg 304 to provide a broader signal reception bandwidth.

The first leg (400) of the main region (220) situated on the second side 4 of the PCB 8 (or dielectric substrate 6) has a width of preferably about 9.5 millimeters, an outside length of preferably about 11.1 centimeters (which includes the width of second leg 402 and fourth leg 406), and an inside length of preferably about 8.5 centimeters (which includes the width of fourth leg 406). The inside length side of the first leg (400) of the main region (220) is spaced from the UHF region (270) by a gap of preferably approximately 6.5 millimeters. The second leg (402) of the main region (220) has an overall length of preferably approximately 19.6 centimeters (which includes the widths of the first and third legs (400, 404)), and the width of the second leg (402) is preferably approximately 2.55 centimeters. The overall length of the third leg (404) of the main region (220) is preferably about 11.1 centimeters on its outside dimension and preferably about 8.5 centimeters on its inside dimension (that is, outside and inside with respect to the edge of the PCB 8). The width of the third leg (404) of the main region (220) is preferably about 9.5 centimeters. The extended fourth leg (406) of the main region (220) has an overall length of preferably about 7.0 centimeters (which includes the width of the third leg (404)) with an inside length dimension of preferably about 6.05 centimeters. The width of the fourth leg (406) of the main region (220) is preferably approximately 9.55 millimeters. The spacing between the second leg (402) of the main region (220) and the UHF region (270) is a gap of preferably approximately 6.5 millimeters and the spacing between the second leg (402) of the main region (220) and the ground plane region (230) is preferably about 6.5 millimeters. The spacing between the third leg (404) of the main region (220) and the ground plane region (230) is a gap of preferably about 6.5 millimeters. The spacing between the fourth leg (406) of the main region (220) and the UHF region (270) is preferably about 6.5 millimeters.

First supplemental region 150 (250) is preferably approximately 9.5 millimeters in width by preferably approximately 8.35 centimeters in length and separated from main region 120 (220) by a gap of preferably approximately 2 millimeters. First supplemental region 150 (250) is electrically coupled to main region 120 (220) through inductors L3 (L5), which may be a high Q surface-mounted chip inductor L3 on the first side 2 of the printed circuit board 8 (see FIG. 8), and a similar inductor (L5) on the second side 4 of the printed circuit board 8 (see FIG. 9). It has been found that this arrangement extends the effective electrical length of first supplemental region 150 (250). Alternatively, inductors L3 (L5) may be omitted, with the first supplemental region 150 (250) being coupled to main region 120 (220) through its close proximity to main region 120 (220).

Second supplemental region 160 (260) is substantially identical to first supplemental region 150 (250) in dimensions (i.e., preferably about 9.5 millimeters in width by preferably about 8.35 centimeters in length and separated from main region 120 (220) by a gap of preferably approximately 2 millimeters). Second supplemental region 160 on the first side of the printed circuit board is coupled to main region 120 through capacitor C2, which may be a surface-mounted chip capacitor. Second supplemental region (260) on the second side 4 of the printed circuit board 8 is coupled to main region (220) through an inductor (L4), which may also be a high Q surface-mounted chip inductor. It has been found that second supplemental region 160 (260) coupled via capacitor C2 and inductor (L4) significantly improves the overall voltage standing wave ratio (VSWR) characteristics of the planar antenna for the lower VHF television band of frequencies (50-88 MHz). Alternatively, capacitor C2 and inductor (L4) may be omitted, with the second supplemental region 160 (260) being coupled to main region 120 (220) through its close proximity to main region 120 (220).

There is a reflector region 140 preferably only on the top side of the PCB. Reflector region 140 functions as a reflector for first supplemental region 150. It has been found that reflector region 140 improves the overall performance of the planar antenna in the upper VHF television band of frequencies (174-216 MHz). The reflector region 140 preferably has dimensions of about 6.35 centimeters in width by about 6.35 centimeters in length and is spaced from the first supplemental region 150 by a gap of preferably approximately 6.5 millimeters, and is spaced from the main region 120 by a gap of preferably approximately 6.5 millimeters.

UHF antenna elements 170 (270) feature an "H"-shaped configuration and are formed on the respective sides of the printed circuit board 8 (or dielectric substrate 6). As described above, these two UHF elements are also substantially identical in shape, and one is oriented 90 degrees from the other.

Each opposite end 171 (271) of the H-shaped UHF element 170 (270) is preferably square in shape and is preferably approximately 6.35 centimeters in width by approximately 6.35 centimeters in length. The two ends are connected together with preferably an approximately 2.55 centimeters in width by approximately 3.8 centimeters in length microstrip transmission line 173 (273) to form the "H"-shaped configuration. UHF element 170 (270) is coupled to the approximately middle point of the microstrip transmission line leg of the extended S-shaped VHF element 120 (220) through inductor L1 (L2), preferably a 68 nanohenry (nH) high Q surface-mounted chip inductor (see FIGS. 7 and 9).

The top side 2 of the PCB 8 (or dielectric substrate 6) also includes a ground plane region 130. Ground plane region 130 is preferably rectangular in shape and is preferably approximately 7.9 centimeters in length and approximately 6.35 centimeters in width. The bottom side 4 of the PCB 8 (or dielectric substrate 6) also includes a ground plane region (230). Each of the two end portions (235, 237) of ground plane region (230) is preferably square and is preferably dimensioned to be approximately 6.35 centimeters in length and approximately 6.35 centimeters in width. The length of the interconnecting microstrip transmission line (239) is preferably approximately 3.8 centimeters, and the width is preferably approximately 2.55 centimeters. The ground plane region 130 on the top side 2 of the PCB 8 is electrically coupled to the ground plane region (230) on the bottom side of the PCB 8 by a series of vias 24 formed through the thickness of the PCB 8 (or dielectric substrate 6). The ground plane region 130 is spaced on its length and width sides from the main region 120 by a gap of preferably about 6.5 millimeters. Similarly, the ground plane region (230) is spaced from the main region (220) on its length and width sides by a gap, of preferably about 6.5 millimeters.

Figure 8:
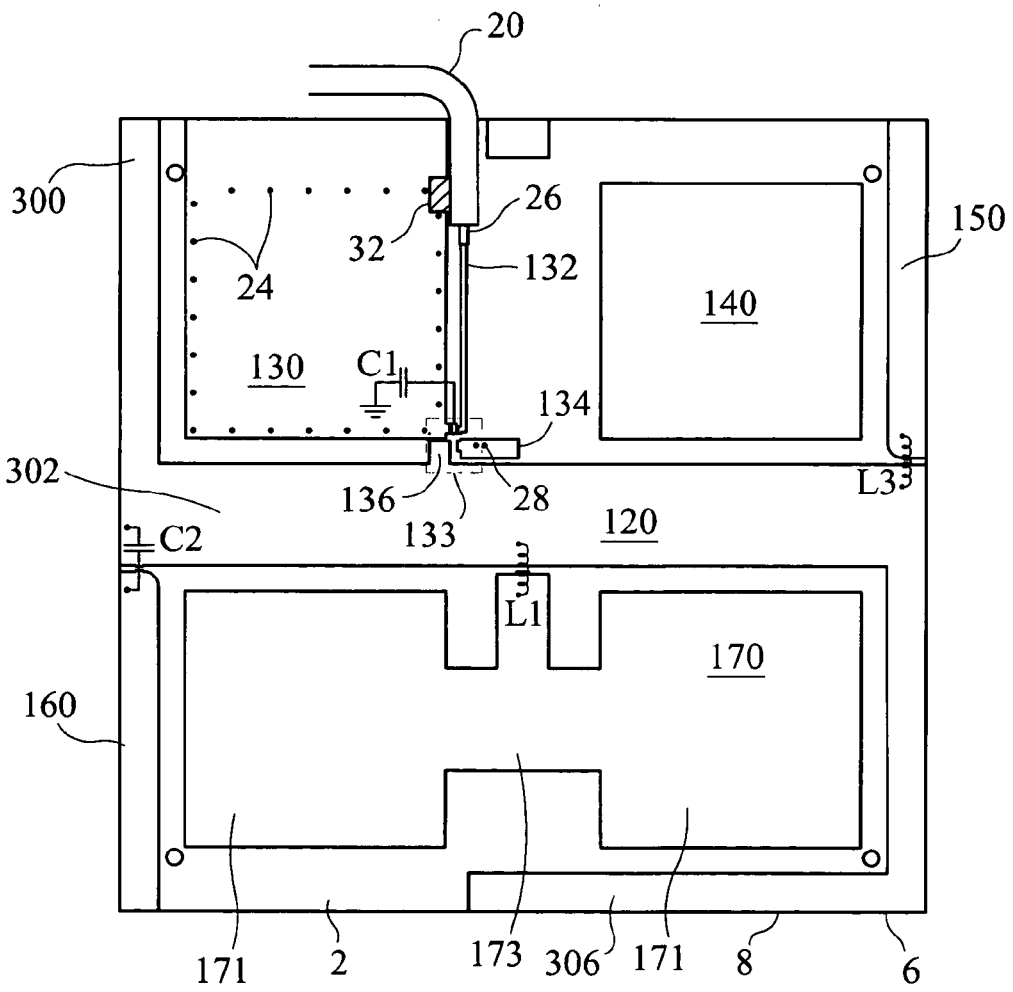
FIG. 8 is a top plan view of the second form of the planar antenna of the present invention, illustrating the values and arrangement of discrete components (e.g., capacitors and inductors) situated thereon.

As illustrated by FIG. 8, it is not necessary to include female "F" connector 131. Rather, the center signal conductor 26 of coaxial cable 20 may be connected directly to transmission line 132, and the ground shield 32 of coaxial cable 20 may be directly connected to ground plane region 130.

Micro strip transmission line 132 extends along the top surface 2 of the PCB 8 from an edge of the PCB 8 to balun transformer 133, the transmission line 132 extending parallel to an edge of ground plane region 130 and spaced apart therefrom by a gap of preferably between about 3 millimeters and about 4 millimeters. The microstrip transmission line 132 has an impedance of preferably 75 ohms to match the impedance of the coaxial cable 20 to which the antenna is connected.

Tables I and II shown below state the gain of the second form of the planar antenna, measured when the antenna is in a vertical disposition and a horizontal disposition, at selected frequencies of interest.

TABLE I (VERTICAL ORIENTATION)

| BAND | FREQUENCY (MHZ) | GAIN (dBm) |
|---|---|---|
| VHF | 177 | −7.35 |
| VHF | 183 | −7.36 |
| VHF | 189 | −5.62 |
| VHF | 195 | −7.00 |
| VHF | 201 | −7.44 |
| VHF | 207 | −6.12 |
| VHF | 213 | −6.65 |
| UHF | 475 | −12.33 |
| UHF | 511 | −6.61 |
| UHF | 547 | −3.84 |
| UHF | 583 | −3.59 |
| UHF | 619 | −1.99 |
| UHF | 655 | −2.71 |
| UHF | 691 | −2.64 |
| UHF | 727 | −2.91 |
| UHF | 763 | −2.23 |
| UHF | 803 | −6.24 |

TABLE II (HORIZONTAL ORIENTATION)

| BAND | FREQUENCY (MHZ) | GAIN (dBm) |
|---|---|---|
| VHF | 177 | −8.29 |
| VHF | 183 | −7.05 |
| VHF | 189 | −6.37 |
| VHF | 195 | −8.71 |
| VHF | 201 | −9.52 |
| VHF | 207 | −7.61 |
| VHF | 213 | −5.98 |
| UHF | 475 | −8.67 |
| UHF | 511 | −9.55 |
| UHF | 547 | −7.2 |
| UHF | 583 | −4.91 |
| UHF | 619 | −4.71 |
| UHF | 655 | −4.2 |
| UHF | 691 | −2.19 |
| UHF | 727 | −0.83 |
| UHF | 763 | −2.78 |
| UHF | 803 | −4.22 |

The values of the discrete components (i.e., inductors and capacitors) may vary depending upon the dielectric substrate 6, or more specifically, the dielectric constant of the printed circuit board 8 which is used. Tables III and IV shown below list the preferred values of the discrete components used for the first and second forms of the planar antenna based on whether the printed circuit board 8 used in the planar antenna is the industry standard "FR4" type or "CEM1" type.

TABLE III

| FIRST FORM OF PLANAR ANTENNA SHOWN IN FIGS. 1-4 | | |
|---|---|---|
| PCB-TYPE | COMPONENT | VALUE |
| FR4 | L1 | 33 nH |
| FR4 | L2 | 33 nH |
| FR4 | L3 | 240 nH |
| FR4 | L4 | 240 nH |
| FR4 | L5 | 220 nH |
| FR4 | C1 | 0.5 pF |
| FR4 | C2 | 3.9 pF |
| CEM1 | L1 | 56 nH |
| CEM1 | L2 | 56 nH |
| CEM1 | L3 | (not used) |
| CEM1 | L4 | (not used) |
| CEM1 | L5 | (not used) |
| CEM1 | C1 | 0.5 pF |
| CEM1 | C2 | 1.0 pF |

TABLE IV

| SECOND FORM OF PLANAR ANTENNA SHOWN TN FIGS. 6-9 | | |
|---|---|---|
| PCB-TYPE | COMPONENT | VALUE |
| FR4 | L1 | 68 nH |
| FR4 | L2 | 68 nH |
| FR4 | L3 | (not used) |
| FR4 | L4 | 47 nH |
| FR4 | L5 | (not used) |
| FR4 | C1 | 3.3 pF |
| FR4 | C2 | (not used) |
| CEM1 | L1 | 68 nH |
| CEM1 | L2 | 68 nH |
| CEM1 | L3 | (not used) |
| CEM1 | L4 | 100 nH |
| CEM1 | L5 | (not used) |
| CEM1 | C1 | 3.3 pF |
| CEM1 | C2 | (not used) |

The dielectric constant of the FR4-type printed circuit board 8 used in first and second forms of the planar antenna is about 4.3 and about 4.5, respectively. The dielectric constant of the CEMI printed circuit board 8 used in the first and second forms of the planar antenna is about 5.0 and about 5.2, respectively.

As may be seen from the previous description, a planar antenna for receiving high definition television signals, formed in accordance with one form of the present invention, includes a dielectric substrate having a first side and a second side disposed opposite the first side. The first and second sides respectively have first and second conductive patterns including segments functioning as antenna elements and form respective first and second modified H-shaped patterns thereon. The first conductive pattern situated on the first side of the dielectric substrate of the planar antenna has a first extended S-shaped segment 120, and the second conductive pattern situated on the second side of the dielectric substrate of the planar antenna has a second extended S-shaped segment (220). Preferably, the first modified H-shaped pattern is disposed substantially ninety degrees with respect to the second modified H-shaped pattern.

In another form of the present invention, a planar antenna for receiving high definition television signals includes a dielectric substrate having a first side and a second side disposed opposite the first side. The first and second sides respectively have first and second conductive patterns including segments functioning as antenna elements and forming respective first and second modified H-shaped patterns thereon. The first modified H-shaped pattern is preferably disposed substantially ninety degrees with respect to the second modified H-shaped pattern.

Even more preferably, the first conductive pattern situated on the first side of the dielectric substrate of the planar antenna includes a first extended S-shaped segment 120. The first extended S-shaped segment 120 includes an elongated main portion 302 centrally located on the first side of the dielectric substrate and which functions as a first transmission line. The elongated main portion 302 has a first axial end and a second axial end situated opposite the first axial end. The first extended S-shaped segment 120 further includes a first sub-segment 304 situated at and operatively coupled to the second axial end of the elongated main portion 302 and disposed perpendicularly to the length of the elongated main portion 302. The first sub-segment 304 of the first extended S-shaped segment 120 functions as a first driven element of the planar antenna. The first sub-segment 304 of the first extended S-shaped segment 120 has a first axial end which is operatively coupled to the second axial end of the elongated main portion 302, and a second axial end situated opposite the first axial end of the first sub-segment 304. The first extended S-shaped segment 120 additionally includes a second sub-segment 300 situated at and operatively coupled to the first axial end of the elongated main portion 302 and disposed perpendicularly to the length of the elongated main portion 302. The second sub-segment 300 of the first extended S-shaped segment 120 functions as a second driven element of the planar antenna. The first extended S-shaped segment 120 further includes a third sub-segment 306 situated at and operatively coupled to the second axial end of the first sub-segment 304 of the first extended S-shaped segment 120 and disposed perpendicularly to the length of the first sub-segment 304, the third sub-segment 306 functioning as a first parasitic element of the planar antenna.

The first conductive pattern situated on the first side of the dielectric substrate further includes a second segment 150. The second segment 150 is situated at and operatively coupled to the second axial end of the elongated main portion 302 of the first extended S-shaped segment 120 and is disposed perpendicularly to the length of the elongated main portion 302. The second segment 150 functions as a third driven element of the planar antenna.

The first extended S-shaped segment 120 further includes a third segment 160. The third segment 160 is situated at and operatively coupled to the first axial end of the elongated main portion 302 of the first extended S-shaped segment 120 and is disposed perpendicularly to the length of the elongated main portion 302. The third segment 160 functions as a second parasitic element of the planar antenna. The first extended S-shaped segment 120, the second segment 150 and the third segment 160 define the first modified H-shaped pattern on the first side of the dielectric substrate of the planar antenna.

Preferably, the second conductive pattern situated on the second side of the dielectric substrate of the planar antenna includes a second extended S-shaped segment (220). The second extended S-shaped segment (220) includes an elongated main portion (402) centrally located on the second side of the dielectric substrate and which functions as a second transmission line. The elongated main portion (402) has a first axial end and a second axial end situated opposite the first axial end. The second extended S-shaped segment (220) further includes a first sub-segment (404) situated at and operatively coupled to the second axial end of the elongated main portion (402) of the second extended S-shaped segment (220) and disposed perpendicularly to the length of the elongated main portion (402) of the second extended S-shaped segment (220). The first sub-segment (404) of the second extended S-shaped segment (220) functions as a fourth driven element of the planar antenna. The first sub-segment (404) of the second extended S-shaped segment (220) has a first axial end which is operatively coupled to the second axial end of the elongated main portion (402) of the second extended S-shaped segment (220), and a second axial end situated opposite the first axial end of the first sub-segment (404) of the second extended S-shaped segment (220). The second extended S-shaped segment (220) additionally includes a second sub-segment (400) situated at and operatively coupled to the first axial end of the elongated main portion (402) of the second extended S-shaped segment (220) and disposed perpendicularly to the length of the elongated main portion (402). The second sub-segment (400) of the second extended S-shaped segment (220) functions as a fifth driven element of the planar antenna. The second extended S-shaped segment (220) further includes a third sub-segment (406) situated at and operatively coupled to the second axial end of the first sub-segment (404) of the second extended S-shaped segment (220) and disposed perpendicularly to the length of the first sub-segment (404) of the second extended S-shaped segment (220). The third sub-segment (406) functions as a third parasitic element of the planar antenna.

The second conductive pattern situated on the second side of the dielectric substrate further includes a fourth segment (250). The fourth segment (250) is situated at and operatively coupled to the second axial end of the elongated main portion (402) of the second extended S-shaped segment (220) and is disposed perpendicularly to the length of the elongated main portion (402) of the second extended S-shaped segment (220). The second segment (250) functions as a sixth driven element of the planar antenna.

The second conductive pattern further includes a fifth segment (260). The fifth segment (260) is situated at and operatively coupled to the first axial end of the elongated main portion (402) of the second extended S-shaped segment (220) and is disposed perpendicularly to the length of the elongated main portion (402) of the second extended S-shaped segment (220). The fifth segment (260) functions as a fourth parasitic element of the planar antenna. The second extended S-shaped segment (220), the fourth segment (250) and the fifth segment (260) define the second modified H-shaped pattern on the second side of the dielectric substrate of the planar antenna.

In an even more preferred form of the present invention, the planar antenna includes a first inductor L3, the first inductor L3 operatively coupling the second segment 150 situated on the first side of the dielectric substrate to the first extended S-shaped segment 120; a first capacitor C2, the first capacitor C2 operatively coupling the third segment 160 situated on the first side of the dielectric substrate to the first extended S-shaped segment 120; a second inductor (L4), the second inductor (L4) operatively coupling the fourth segment (250) situated on the second side of the dielectric substrate to the second extended S-shaped segment (220); and a third inductor (L5), the third inductor (L5) operatively coupling the fifth segment (260) situated on the second side of the dielectric substrate to the second extended S-shaped segment (220). The planar antenna preferably has a dielectric constant in a range of about 5 to about 5.5.

In an even more preferred form of the present invention, the first conductive pattern situated on the first side of the dielectric substrate of the planar antenna further includes a sixth segment 170, a seventh segment 140 and an eighth segment 130. The sixth segment 170 is situated adjacent to and partially surrounded by the elongated main portion 302 of the first extended S-shaped segment 120, the first sub-segment 304 of the first extended S-shaped segment 120, the third sub-segment 306 of the first extended S-shaped segment 120 and the third segment 160. The sixth segment 170 functions as a seventh driven element of the planar antenna. The seventh segment 140 and the eighth segment 130 are situated adjacent to one another and further are situated adjacent to and partially surrounded by the second segment 150, the elongated main portion 302 of the first extended S-shaped segment 120 and the second sub-segment 300 of the first extended S-shaped segment 120. The seventh segment 140 functions as a first reflector of the planar antenna, and the eighth segment 130 functions as a ground plane for the planar antenna.

In another form of the present invention, the second conductive pattern situated on the second side of the dielectric substrate of the planar antenna further includes a ninth segment (230) and a tenth segment (270). The ninth segment (230) is situated adjacent to and partially surrounded by the elongated main portion (402) of the second extended S-shaped segment (220), the first sub-segment (404) of the second extended S-shaped segment (220), the third sub-segment (406) of the second extended S-shaped segment (220) (if the third sub-segment (406) is coupled to the first sub-segment (404)) and the fifth segment (250). The ninth segment (230) functions as a ground plane of the planar antenna. The tenth segment (270) is situated adjacent to and partially surrounded by the elongated main portion (402) of the second extended S-shaped segment (220), the second sub-segment (400) of the second extended S-shaped segment (220), the third sub-segment (406) of the second extended S-shaped segment (220) (if the third sub-segment (406) is coupled to the second sub-segment (400)) and the fourth segment (260). The tenth segment (270) functions as an eighth driven element of the planar antenna.

In yet another form of the present invention, the planar antenna includes a fourth inductor L1 and a fifth inductor (L2). The fourth inductor L1 operatively couples the sixth segment 170 to the elongated main portion 302 of the first extended S-shaped segment 120. The fifth inductor (L2) operatively couples the tenth segment (270) to the elongated main portion (402) of the second extended S-shaped segment (220).

Although the planar antenna of the present invention has been described herein as being formed on a printed circuit board, it is envisioned to be within the scope of the present invention to use different types of material as the substrate. For example, a flexible PVC (polyvinyl chloride) material with conductive paint or silkscreen as the antenna's elements situated on both sides of the PVC material may be used. Alternatively, the fiberglass printed circuit board material may be replaced with a Plexiglas type material and using a 3M brand copper conductive tape as the antenna's conductive elements may be used.

Furthermore, although the planar antenna is described herein with a 9.75 inch by 9.75 inch printed circuit board, such as shown in FIGS. 1-4, or a 7.75 inch by 7.75 inch printed circuit board, such as shown in FIGS. 6-9, a smaller or larger version of the antenna is envisioned, with the dimensions of the antenna elements scaled proportionately to what is described herein. The thickness of the dielectric substrate of the planar antenna shown in FIGS. 1-4 is preferably about 2 millimeters, and the thickness of the dielectric substrate of the planar antenna shown in FIGS. 6-9 is preferably about 1 millimeter.

Additionally, the planar antenna of the present invention may be suitable for use both indoors and outdoors.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A planar antenna for receiving high definition television signals, which comprises:

a dielectric substrate having a first side and a second side disposed opposite the first side, the first and second sides respectively having first and second conductive patterns including segments functioning as antenna elements and forming respective first and second modified H-shaped patterns thereon, the first conductive pattern situated on the first side of the dielectric substrate of the planar antenna further having a first extended S-shaped segment, the second conductive pattern situated on the second side of the dielectric substrate of the planar antenna further having a second extended S-shaped segment, each of the first and second extended S-shaped segments comprising an S-shaped segment and an extended segment, the S-shaped segment comprising an elongated main portion and two sub-segments perpendicularly connected to ends of the elongated main portion; wherein each of the extended segments is perpendicularly connected to an end of each of the S-shaped segments and acts as a parasitic element for the planar antenna.

2. The planar antenna for receiving high definition television signals as defined by claim 1, wherein the first modified H-shaped pattern is disposed substantially ninety degrees with respect to the second modified H-shaped pattern.

3. A planar antenna for receiving high definition television signals, which comprises:

a dielectric substrate having a first side and a second side disposed opposite the first side, the first and second sides respectively having first and second conductive patterns including segments functioning as antenna elements and forming respective first and second modified H-shaped patterns thereon, the first modified H-shaped pattern being disposed substantially ninety degrees with respect to the second modified H-shaped pattern;

wherein the first conductive pattern situated on the first side of the dielectric substrate of the planar antenna includes:

a) a first extended S-shaped segment, the first extended S-shaped segment including:

a1) an elongated main portion centrally located on the first side of the dielectric substrate and which functions as a first transmission line, the elongated main portion having a first axial end and a second axial end situated opposite the first axial end;

a2) a first sub-segment situated at and operatively coupled to the second axial end of the elongated main portion and disposed perpendicularly to the length of the elongated main portion, the first sub-segment of the first extended S-shaped segment functioning as a first driven element of the planar antenna, the first sub-segment of the first extended S-shaped segment having a first axial end which is operatively coupled to the second axial end of the elongated main portion, and a second axial end situated opposite the first axial end of the first sub-segment;

a3) a second sub-segment situated at and operatively coupled to the first axial end of the elongated main portion and disposed perpendicularly to the length of the elongated main portion, the second sub-segment of the first extended S-shaped segment functioning as a second driven element of the planar antenna; and a4) a third sub-segment situated at and operatively coupled to the second axial end of the first sub-segment of the first extended S-shaped segment and disposed perpendicularly to the length of the first sub-segment, the third sub-segment functioning as a first parasitic element of the planar antenna;

b) a second segment, the second segment being situated at and operatively coupled to the second axial end of the elongated main portion of the first extended S-shaped segment and disposed perpendicularly to the length of the elongated main portion, the second segment functioning as a third driven element of the planar antenna; and c) a third segment, the third segment being situated at and operatively coupled to the first axial end of the elongated main portion of the first extended S-shaped segment and disposed perpendicularly to the length of the elongated main portion, the third segment functioning as a second parasitic element of the planar antenna;

whereby the first extended S-shaped segment, the second segment and the third segment define the first modified H-shaped pattern on the first side of the dielectric substrate of the planar antenna;

and wherein the second conductive pattern situated on the second side of the dielectric substrate of the planar antenna includes:

d) a second extended S-shaped segment, the second extended S-shaped segment including:

d1) an elongated main portion centrally located on the second side of the dielectric substrate and which functions as a second transmission line, the elongated main portion having a first axial end and a second axial end situated opposite the first axial end;

d2) a first sub-segment of the second extended S-shaped segment situated at and operatively coupled to the second axial end of the elongated main portion of the second extended S-shaped segment and disposed perpendicularly to the length of the elongated main portion of the second extended S-shaped segment, the first sub-segment of the second extended S-shaped segment functioning as a fourth driven element of the planar antenna, the first sub-segment of the second extended S-shaped segment having a first axial end which is coupled to the second axial end of the elongated main portion of the second extended S-shaped segment, and a second axial end situated opposite the first axial end of the first sub-segment of the second extended S-shaped segment;

d3) a second sub-segment of the second extended S-shaped segment situated at and operatively coupled to the first axial end of the elongated main portion of the second extended S-shaped segment and disposed perpendicularly to the length of the elongated main portion, the second sub-segment of the second extended S-shaped segment functioning as a fifth driven element of the planar antenna, the second sub-segment of the second extended S-shaped segment having a first axial end which is coupled to the first axial end of the elongated main portion of the second extended S-shaped segment, and a second axial end situated opposite the first axial end of the second sub-segment of the second extended S-shaped segment; and d4) a third sub-segment of the second extended S-shaped segment situated at and operatively coupled to one of the second axial end of the first sub-segment of the second extended S-shaped segment and disposed perpendicularly to the length of the first sub-segment of the second extended S-shaped segment and the second axial end of the second sub-segment of the second extended S-shaped segment and disposed perpendicularly to the length of the second sub-segment of the second extended S-shaped segment, the third sub-segment functioning as a third parasitic element of the planar antenna;

e) a fourth segment, the fourth segment being situated at and operatively coupled to the second axial end of the elongated main portion of the second extended S-shaped segment and disposed perpendicularly to the length of the elongated main portion of the second extended S-shaped segment, the second segment functioning as a sixth driven element of the planar antenna; and f) a fifth segment, the fifth segment being situated at and operatively coupled to the first axial end of the elongated main portion of the second extended S-shaped segment and disposed perpendicularly to the length of the elongated main portion of the second extended S-shaped segment, the fifth segment functioning as a fourth parasitic element of the planar antenna;

whereby the second extended S-shaped segment, the fourth segment and the fifth segment define the second modified H-shaped pattern on the second side of the dielectric substrate of the planar antenna.

4. The planar antenna for receiving high definition television signals as defined by claim 3, which further comprises:

a first inductor, the first inductor operatively coupling the second segment situated on the first side of the dielectric substrate to the first extended S-shaped segment;

a first capacitor, the first capacitor operatively coupling the third segment situated on the first side of the dielectric substrate to the first extended S-shaped segment;

a second inductor, the second inductor operatively coupling the fourth segment situated on the second side of the dielectric substrate to the second extended S-shaped segment; and a third inductor, the third inductor operatively coupling the fifth segment situated on the second side of the dielectric substrate to the second extended S-shaped segment.

5. The planar antenna for receiving high definition television signals as defined by claim 4, wherein the dielectric substrate has a dielectric constant in a range of about 5 to about 5.5.

6. The planar antenna for receiving high definition television signals as defined by claim 3, wherein the first conductive pattern situated on the first side of the dielectric substrate further includes:

g) a sixth segment, the sixth segment being situated adjacent to and partially surrounded by the elongated main portion of the first extended S-shaped segment, the first sub-segment of the first extended S-shaped segment, the third sub-segment of the first extended S-shaped segment and the third segment, the sixth segment functioning as a seventh driven element of the planar antenna;

h) a seventh segment; and i) an eighth segment, the seventh segment and the eighth segment being situated adjacent to one another and further being situated adjacent to and partially surrounded by the second segment, the elongated main portion of the first extended S-shaped segment and the second sub-segment of the first extended S-shaped segment, the seventh segment functioning as a first reflector of the planar antenna, the eighth segment functioning as a ground plane for the planar antenna.

7. The planar antenna for receiving high definition television signals as defined by claim 6, wherein the second conductive pattern situated on the second side of the dielectric substrate further includes:

j) a ninth segment, the ninth segment being situated adjacent to and partially surrounded by the elongated main portion of the second extended S-shaped segment, the first sub-segment of the second extended S-shaped segment, and the fifth segment, the ninth segment functioning as a ground plane of the planar antenna; and k) a tenth segment, the tenth segment being situated adjacent to and partially surrounded by the elongated main portion of the second extended S-shaped segment, the second sub-segment of the second extended S-shaped segment and the fourth segment, the tenth segment functioning as an eighth driven element of the planar antenna.

8. The planar antenna for receiving high definition television signals as defined by claim 7, which further comprises:

a fourth inductor, the fourth inductor operatively coupling the sixth segment to the elongated main portion of the first extended S-shaped segment; and a fifth inductor, the fifth inductor operatively coupling the tenth segment to the elongated main portion of the second extended S-shaped segment.

* * * * *